United States Patent [19]

Scholl et al.

[11] 3,965,856

[45] June 29, 1976

[54] ADHESIVE WHEEL APPLICATOR DEVICE

[75] Inventors: Charles H. Scholl, Vermilion; Alan B. Reighard, Bay Village, both of Ohio

[73] Assignee: Nordson Corporation, Amherst, Ohio

[22] Filed: Dec. 27, 1974

[21] Appl. No.: 536,730

[52] U.S. Cl. ..... 118/202; 118/245; 118/261

[51] Int. Cl.[2] ..... B05C 1/02

[58] Field of Search ..... 118/258, 262, 259, 261, 118/245, 202, 7; 101/363, 364

[56] References Cited

UNITED STATES PATENTS

| | | | |
|---|---|---|---|
| 509,213 | 11/1893 | Friedlander | 118/245 X |
| 1,206,641 | 11/1916 | Ackermann | 118/245 |
| 3,154,434 | 10/1964 | Rosenthal | 118/245 |
| 3,255,727 | 6/1966 | Boothroyd | 118/7 |
| 3,353,517 | 11/1967 | Tower | 118/261 |
| 3,465,711 | 9/1969 | Woodman | 118/7 X |
| 3,605,686 | 9/1971 | Copithorne | 118/261 X |

*Primary Examiner*—John P. McIntosh
*Attorney, Agent, or Firm*—Wood, Herron & Evans

[57] ABSTRACT

A device including an applicator wheel for applying molten adhesive to a substrate as the substrate is moved over the surface of the wheel. The device includes a reservoir within which the wheel is partially submerged in molten adhesive and a doctor blade for controlling the thickness of adhesive applied to the substrate. The reservoir is so configurated that so long as the wheel is rotating, there is a continuous flow of molten adhesive from the pool beneath the wheel up to the doctor blade, along the underside of the doctor blade and back to the pool via channels in the end plates of a reservoir. To prevent the substrate from adhering to the surface of the wheel, stripper fingers extend parallel to the path of movement of the substrate and ride within annular channels or grooves in the periphery of the wheel. These stripper fingers are preloaded into contact with the surface of the wheel and are encased within "Teflon" tubing so configured in relation to the grooves in the surface of the wheel that the tubing functions as a dynamic seal to prevent adhesive from riding up the grooves and beneath the doctor blade.

17 Claims, 10 Drawing Figures

ADHESIVE WHEEL APPLICATOR DEVICE

This invention relates to adhesive applicator devices and especially to applicator devices of the type which employ a rotatable wheel to apply the adhesive to a substrate. One specific application wherein the invention may be used to particular advantage is in connection with wheel type applicators for applying very viscous molten adhesives or so-called "hot melt" adhesives to substrates. Hot melt adhesives are characterized by being solid at room temperature but when heated convert to molten form. In the molten state they are relatively viscous liquids which are typically applied either through the nozzle of an applicator tool or gun by means of an applicator wheel. The wheel applicators are driven in rotation through a pool or reservoir of molten adhesive and in the course of passage through the reservoir take up a deposit of adhesive onto the surface of the wheel. This deposit is then applied to a substrate as that substrate is moved over the surface of the wheel.

In wheel type hot melt applicators, solid adhesive material is usually heated to a molten state and then supplied as a liquid to a reservoir from whence it is subsequently removed by rotation of the applicator wheel through the pool of liquid adhesive in the reservoir. Within the reservoir the molten material is maintained at a suitable level to avoid either insufficient or excessive deposits of the adhesive on the wheel. Preferably, the adhesive level in the reservoir is maintained as low as possible so as to minimize the quantity of adhesive in the molten state in the reservoir. Minimization of the quantity of material in the pool is preferred because many "hot melt" adhesives degrade while in the molten state from exposure to excessive heat or exposure to heat over a prolonged period of time in the presence of air or oxygen.

In order to minimize the quantity of adhesive maintained in the molten state in the reservoir, the wheel applicator of this invention is operative to maintain a constant flow of adhesive along the underside of a film thickness control doctor blade and back to the reservoir pool. This constant flow along the underside of the doctor blade minimizes the quantity of liquid adhesive required in the reservoir to achieve full surface "wetting" of the wheel by a minimum quantity of adhesive in the reservoir.

Commonly, wheel type adhesive applicators employ stripper fingers which extend parallel to the path of movement of the substrate over the wheel and prevent the substrate from adhering to and wrapping around the wheel. These stripper fingers generally ride within peripheral grooves in the wheel so that they do not interfere with surface contact between the wheel and substrate. One common problem in all adhesive wheel type applicators and particularly in applicators for applying very viscous adhesives to substrates is that of preventing build-up of adhesive around the stripper fingers and consequent uneven deposits of adhesive from the wheel onto the substrate.

One aspect of this invention is predicated upon the discovery of an improved stripper finger and stripper finger dynamic seal which prevents adhesive from flowing beneath the doctor blade through the stripper finger grooves of the applicator wheel and forming large deposits of adhesive around the stripper fingers. This aspect of the invention is predicated upon the discovery that "Teflon" or resilient tubes of greater diameter than the width of the grooves or channels in the wheel may be placed over the stripper fingers and forced into the peripheral grooves of the wheel by the doctor blade so as to form a very effective seal between the doctor blade and the wheel peripheral grooves. Preferably the tubing is slightly larger in inside diameter than the outside diameter of the stripper finger wire and slightly larger in outside diameter than the width of the channels or grooves in the applicator wheel. This relative sizing enables the tubing to be forced by the doctor blade to the bottoms of the channels or grooves but still enables the tubing to bulge from the top of the channel and be forced by the doctor blade into a sealing condition.

The primary advantage of this invention is that it enables many hot melt adhesives which had heretofore been incapable of application by wheel applicators to be so applied. It also enables hot melt adhesives to be used for applications and on substrates which heretofore had not been suitable for use with wheel type applicator devices.

These and other objects of the invention will be more readily apparent to persons skilled in the art to which the invention pertains from the following description of the drawings in which.

Figure 1:
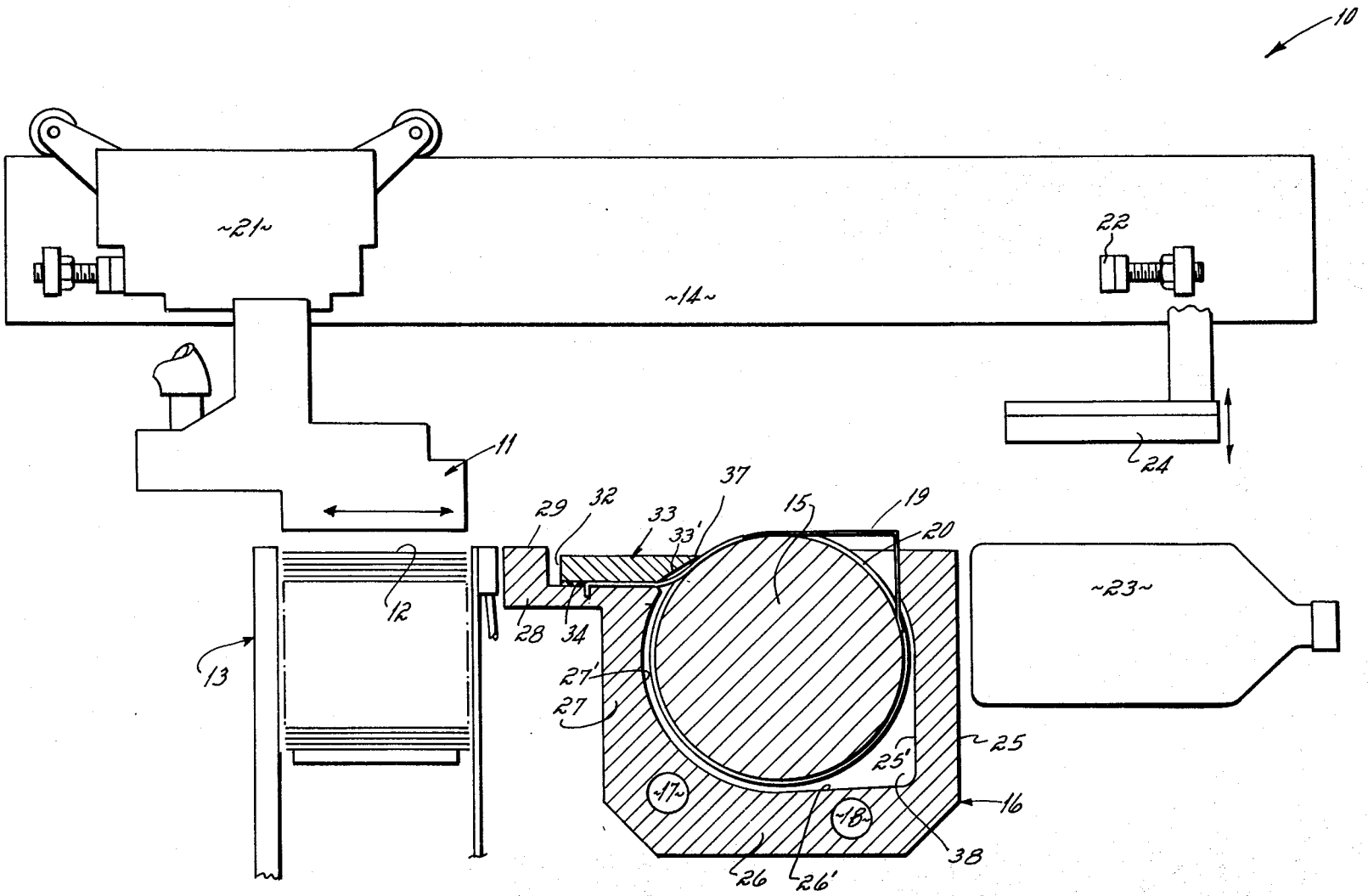
FIG. 1 is a partially diagrammatic cross-sectional view of a machine incorporating the invention of this application.

Referring first to FIG. 1, the invention of this application is illustrated as applied to a conventional labeling machine. While the invention is so illustrated, it should be appreciated that the adhesive reservoir and applicator wheel of this invention is applicable to any discrete label or continuous web labeling machine or to any machine in which adhesive is applied to a substrate from a reservoir by a wheel applicator. then The labeling machine 10 of FIG. 1 comprises a conventional suction mouth piece 11 operable to lift labels 12 from a stack of labels contained within a magazine 13. After lifting the top-most label 12 from the stack of labels, the suction mouth piece 11 is operative to move forwardly over a guide track 14 and in so doing passes the label supported from the mouth piece over an adhesive applicator wheel 15. This wheel is rotatable within a reservoir 16 of molten adhesive within which the adhesive is maintained in a molten state by conventional thermostat controlled heater cartridges 17 and 18. While the label is passed over the wheel 15, stripper fingers 19 which ride within peripheral grooves 20 of the wheel, prevent the label from adhering to the wheel. The suction mouth piece carrying slide 21 continues to move forwardly until it contacts a front cushion stop 22 where its forward motion is arrested with the label 12 carried by the suction mouth piece 11 located immediately over a bottle, container or other object 23 to which an adhesive applied label is to be adhered. The suction mouth piece 11 then descends to place the label in contact with the container or substrate 23 at which point the vacuum on the suction mouth piece 11 is released. The label 12 is then left in place on the container 23 as the suction mouth piece 11 is lifted away from the container and moved rearwardly to the position illustrated in FIG. 1. As the suction mouth piece moves rearwardly, an overhead pressure pad 24 is moved downwardly so as to press the label 12 into intimate contact with the container 23. The cycle is then repeated as new bottles, containers or substrates 23 are moved into position to receive labels 12 from the magazine.

The machine 10 heretofore described except for the applicator wheel and reservoir section is a conventional commercially available machine which forms no part of the invention of this application. Descriptions of machines of this general type may be found in U.S. Pat. No. 2,720,995 and No. 2,707,915. The invention of this application resides solely in the reservoir section of the machine, including the applicator wheel 15 and reservoir 16.

The reservoir 16 comprises an open top container within which the applicator wheel 15 is rotatable. This container has front and bottom inside walls 25, 26, the inside surfaces 25′, 26′ of which extend generally tangentially to the periphery of the wheel 15. The reservoir has a rear wall 27, the inside surface 27′ of which is arcuate in contour and is closely spaced to the periphery of the wheel 15. The top of the rear wall terminates in a shelf 28, the rearwardmost portion of which has an upstanding flange 29 through which a pair of adjustment screws 30, 31 are threaded. These screws abut against the rear edge 32 of a doctor blade 33 and facilitate coarse adjustment of the doctor blade relative to the wheel 15. The doctor blade 33 rests atop a compressible gasket 34 and is secured to the shelf 28 by screws 35 which pass through elongated vertical apertures 36 in the blade. The spacing of the leading edge 37 of the doctor blade from the periphery of the wheel 15 controls the thickness of the film of adhesive applied to the surface of the wheel. This thickness may be adjusted first by the screws 30, 31 to obtain a coarse adjustment and then secondly by tightening the screws 35 to obtain a fine adjustment, the latter adjustment being a function of the compression of the gasket 34

The ends of the reservoir 16 are closed by end plates 40, 41 both of which have bushings 102, 103 mounted therein for rotational support of the center shaft 44 of the applicator wheel 15. This center shaft 44 is rigidly secured to the wheel and has a driving key slot 45 in one end by means of which the wheel 15 may be rotated via a drive shaft 101 and connecting drive sleeve 104. In practice the drive shaft 101 is operable to rotate the center shaft 44 so as to drive the applicator wheel at a speed which causes the periphery of the wheel to move at a speed and in the direction of transport of the labels 12 over the surface of the wheel.

Figures 5, 6, 7:
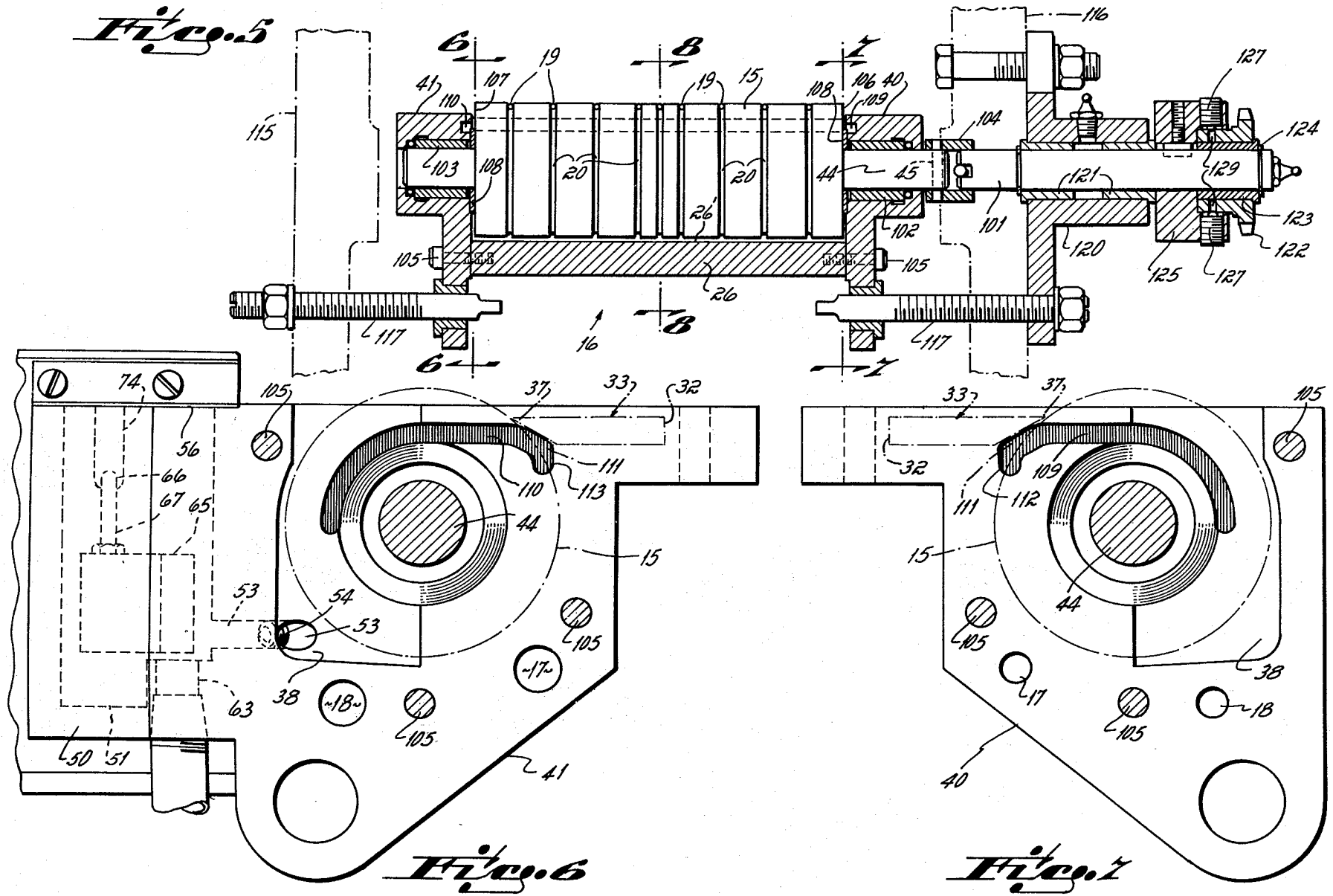
FIG. 5 is a cross-sectional view of the reservoir section of the machine taken on line 5—5 of FIG. 4.
FIG. 6 is a cross-sectional view taken on line 6—6 of FIG. 5.
FIG. 7 is a cross-sectional view taken on line 7—7 of FIG. 5.

Referring to FIGS. 5, 6 and 7 it will be seen that the end plates 40, 41 are secured to the central section of the reservoir by machine screws 105. Preferably the end plates are spaced from the radial faces 106, 107 of the applicator wheel 15 by washers or spacers 108. Spaced radially outwardly from the washers there are adhesive flow directing grooves or channels 109 and 110 formed on the inside faces of the end plates 40, 41. These grooves are both generally arcuate in contour and, as may best be seen in FIG. 8, intersect a channel 111 extending along the underside of the doctor blade at one end 112, 113 of each of the grooves 109, 110 respectively. Molten adhesive accumulated in the channel 111 under the doctor blade is free to flow laterally from beneath the doctor blade into the grooves 109, 110 and back down into the open section 38 at the bottom of the reservoir.

It is to be noted that the rear and bottom walls 27′, 26′ of the reservoir 16 are spaced close to the periphery of the applicator wheel 15. This spacing enables the wheel 15 to act as a pump and supply adhesive from the bottom open portion 38 of the reservoir to the underside of the doctor blade 33. From the underside of the doctor blade, the adhesive flows outwardly along the underside 33′ of the doctor blade to the end plate channels 109 and 110 and subsequently back to the bottom of the reservoir. In the dynamic operating condition of the reservoir 16 and applicator wheel 15, a continuous flow of molten adhesive is maintained along the underside of the doctor blade, through the channels 109 and 110 and back to the reservoir. Consequently, little or no liquid material need be or is maintained in the open section 38 of the reservoir. This open section 38 generally serves only as a distribution channel for incoming or recycled liquid adhesive and as a drain of liquid when the reservoir and wheel are in a static or non-operating condition.

As may best be seen in FIG. 5 the reservoir is secured to frame plates 115, 116 of the labeling machine 10 by conventional threaded connectors 117. These connectors extend through apertures in the frame plates 115, 116 and aligned apertures of the reservoir side plates 40, 41.

The drive shaft 101 which is operative to drive the applicator wheel 15 is mounted for rotation in a supporting bracket 120 within which there is a journal sleeve 121. In order to impart driving rotation to the drive shaft 101, a chain driven sprocket 122 is rotatably journalled on the outer end of the shaft 101. This sprocket 122 is supported for rotation on a bushing 123 which is secured to the shaft by a snap ring 124. The chain driven sprocket 122 is drivingly connected to a sleeve 125 and the sleeve 125 is drivingly keyed to the shaft 101. The driving connection between the sleeve 125 and the sprocket 122 comprises a plurality of spring biased detent pins 127 mounted in the sleeve 125 and engageable with recesses 129 in the hub of the sprocket. The detents function as torque limiting drive devices such that in the event that the wheel 15 is not free for rotation, the detent pins 127 will "ratchet" and function as slip elements permitting the drive sprocket 122 to rotate without imparting rotation to the drive sleeve 125. This ratcheting drive or slip drive feature precludes the operator from breaking the machine by turning it on prior to having warmed the reservoir and converted residual solid adhesive in the reservoir to the molten state.

As mentioned hereinabove, the stripper fingers 19 function to prevent labels or substrates to which adhesive is being applied by the applicator wheel 15 from adhering to and wrapping around the applicator wheel. These stripper fingers 19 comprise a plurality of wires which extend generally horizontally parallel to the path of travel of the substrate over the wheel and in the plane of the top surface of the wheel. To enable the top surface of the stripper fingers to be located in the horizontal plane of the top surface of the applicator wheel 15, the stripper fingers ride within annular channels or grooves 20 in the periphery of the wheel.

Figure 8:
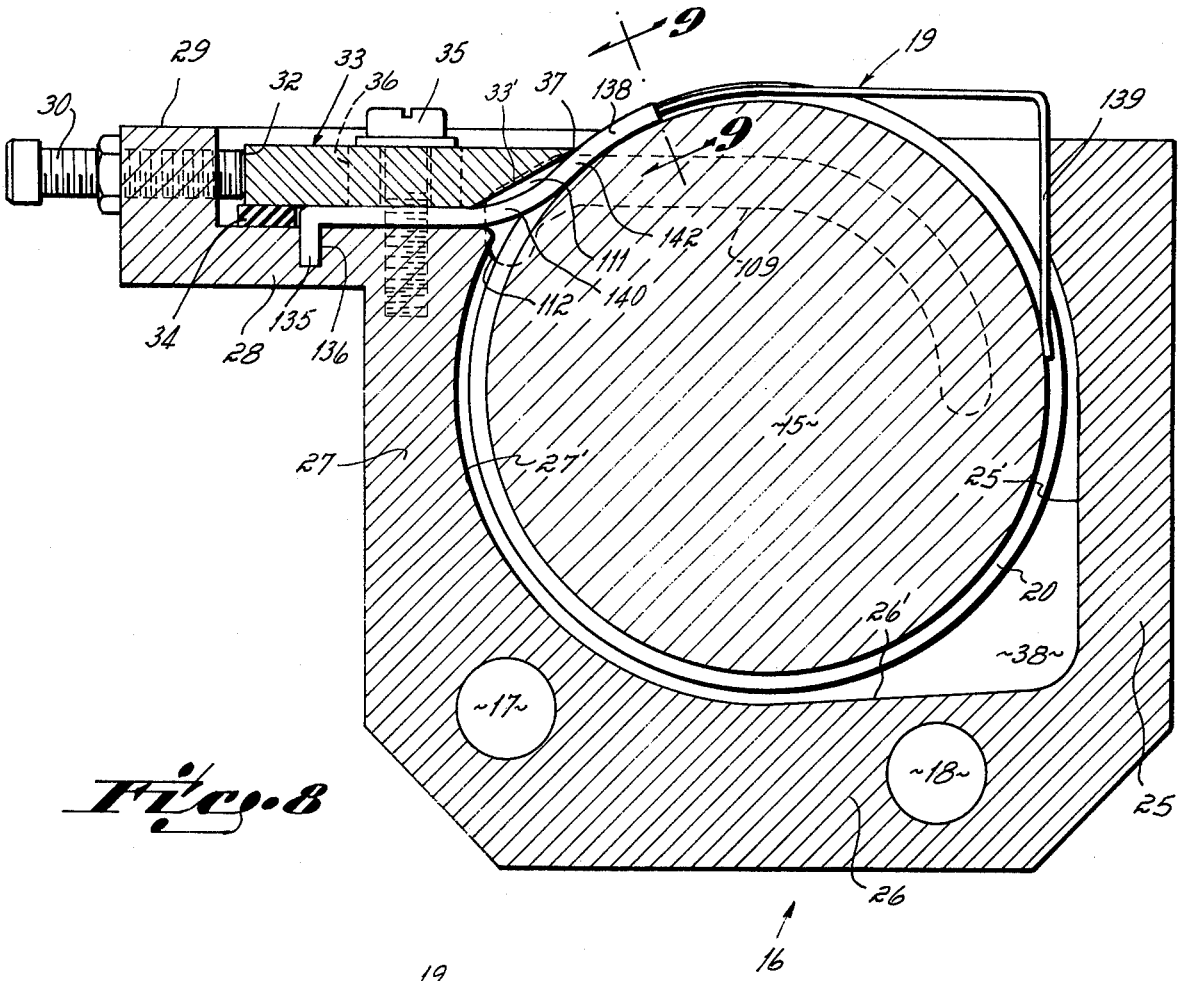
FIG. 8 is a cross-sectional view tkan on line 8—8 of FIG. 5.
Figure 9:
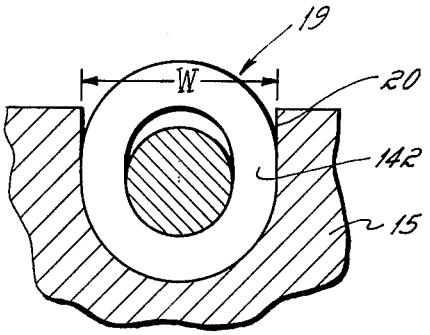
FIG. 9 is an enlarged cross-sectional view through one stripper finger taken on line 9—9 of FIG. 8.

As may clearly be seen in FIGS. 8 and 12 the stripper fingers 19 are mounted on the horizontal shelf 28 of the reservoir and extend forwardly over the top of the wheel 15. Each stripper finger comprises a downwardly bent end section 135 fitted into a vertical bore 136 of the shelf 28. From the end section 135 each finger extends horizontally forwardly along the top surface of the shelf and within a channel or groove of the compressible gasket 34. The straight shelf supporting section of the finger then merges into an arcuate section 138 which extends through the annular groove 20 of the wheel up over the top of the wheel. The finger then extends forwardly from the top of the wheel in a horizontal plane to the front edge of the reservoir opening where it is bent at 90° and extends downwardly in a vertical section 139 back into the forwardmost portion of the channel in the wheel.

Figure 10:
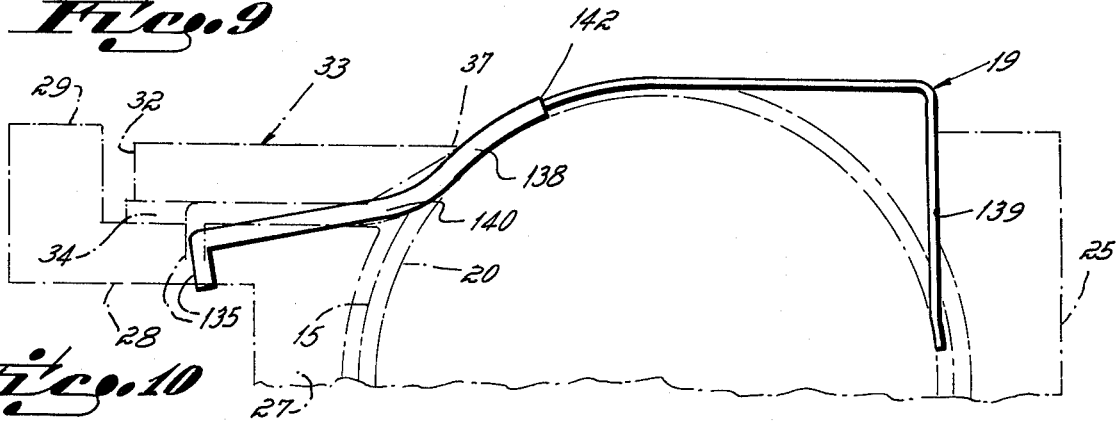
FIG. 10 is a view similar to a portion of FIG. 8 but illustrating the shape of the stripper fingers prior to preloading and mounting in the reservoir.

To insure that the stripper fingers ride within the groove 20 and are maintained in contact with the wheel, the stripper fingers are made from spring steel and are preloaded into contact with the wheel. The shape of the unstressed or unpreloaded spring steel stripper finger is illustrated in FIG. 10 where the finger is shown superimposed upon the phantom section reservoir. Mounting of the stripper fingers onto the reservoir causes the intersection 140 of the arcuate section 138 and straight section 137 to be deflected and thereby to force the arcuate section 138 into intimate contact with the bottom of the channel 20 in the periphery of the wheel.

One of the most common problems associated with the application of molten adhesive or very viscous adhesive to a substrate by means of a wheel applicator is that of preventing adhesive from traveling beneath the leading edge 37 of the doctor blade 33 through the annular wheel channels 20 and collecting around the stripper fingers 19. When collected around the stripper fingers the adhesive results in large and uneven deposits of adhesive onto the substrate.

To prevent adhesive from riding up through the channels or peripheral grooves 20 of the applicator wheel beneath the leading edge of the doctor blade 33, the rearwardmost portion of each of the stripper fingers is encased within a Teflon sleeve 142. This sleeve is so sized relative to the stripper finger 19 over which it is mounted and the channel 130 of the wheel within which it rides that it forms a very effective seal to prevent adhesive from flowing from beneath the leading edge 37 of the doctor blade through the channel 20. In one preferred embodiment of the invention the groove 20 has a width W of 0.062 inch. The stripper finger 19 has an outside diameter of 0.032 inch. The Teflon sleeve in this instance has an inside diameter of 0.034 inch and an outside diameter of 0.066 inch. Consequently, the Teflon sleeve when forced into the channel 130 is free to move to the bottom of the channel but bulges around the top of the wire and outside the top of the channel. When this bulging Teflon sleeve is forced by the leading edge 37 of the doctor blade into intimate contact with the wheel the sleeve forms a very effective dynamic seal between the stripper fingers and the applicator wheel at the leading edge 37 of the doctor blade.

A surge tank containing elbow bracket 50 is attached to the front side of the reservoir end plate 41. This bracket 50 has an open top surge tank recess or cavity 51 which receives molten adhesive from a melt tank 52 and dispenses it to the reservoir 16 via a flow passage 53 between the surge tank 51 and the open channel 38 of the reservoir 16. In the preferred embodiment the passage 53 has a throughput control in the form of an adjustable needle valve 54 extending into the passage. The needle valve 54 is threaded into the end plate 41 and intersects the passage 53 within the end plate. By adjusting the needle valve 54, the rate of flow from the surge tank to the reservoir 16 may be controlled. The needle valve 54 may be secured in an adjusted position by a lock nut 55. In the preferred embodiment, the surge tank is closed at the top by a closure plate 56.

Molten material is supplied to the surge tank 51 from the melt tank 52 via a single acting reciprocating piston pump 60 which is similar to the piston pump disclosed in U.S. Pat. No. 3,815,755 issued on June 11, 1974 and assigned to the assignee of this application. The outlet of the pump 60 is connected to the surge tank 51 via a conduit 61 which opens into the bottom of the surge tank via a bottom port 63.

Located within the surge tank 51 there is a movable displacer 65. This displacer is supported from a generally U-shaped arm 66, one end 67 of which is secured to the displacer and the opposite end 68 of which is mounted in a pivot shaft 69. The pivot shaft has a vertical bore 70 into which the end 68 of the arm 66 is seated and in which it is secured by a set screw 71.

The pivot shaft 69 is mounted for rotation within nylon bushings 72 mounted in the sidewalls of the level control enclosure 73. This enclosure is bolted or otherwise fixedly secured to the elbow bracket 50 by fasteners (not shown) and is slotted in its side wall as illustrated at 74 to accommodate vertical movement of the arm 66.

Mounted on top of the pivot shaft 69 there is a switch mounting clip 80. This clip is secured to the shaft by a rivet or other conventional connector such that its open end extends upwardly. A conventional mercury switch 81 is mounted in the clip in such a position that when the pivot shaft 69 is rotated in one direction, it causes the contacts of the switch to be closed and when rotated in the opposite direction the switch contacts are opened.

A balance arm in the form of a screw 82 is threaded through a threaded aperture 83 of the pivot shaft 69. This balance arm has a balance in the form of a thumb screw 84 on its outer end. By rotating this thumb screw 84 the screw 82 may be adjusted to a position in which the weight of the thumb screw 84 counterbalances the weight of the displacer 65. The thumb screw may be locked in an adjusted position by a lock nut 86. The position of the thumb screw is selected so that in the absence of any liquid in the surge tank 51 the displacer moment acting on the pivot shaft 69 is greater than the moment of the thumb screw acting on the same pivot shaft 69. Consequently, in the absence of liquid in the surge tank 51 the displacer causes the pivot shaft 69 to rotate in a clockwise direction as viewed in FIG. 3 to the lower extent of movement of the displacer 65. The counterweight position is selected so as to supply a greater force on its side of the axis of the pivot when the displacer 65 displaces a predetermined amount of the molten adhesive. When this occurs, displacer 65 rises with the liquid level and pivots the pivot shaft in a counterclockwise direction, thereby pivoting the mercury switch 81 on the same pivot shaft and closing the contacts 87 of the switch 81.

Figures 1, 2, 3, 4:
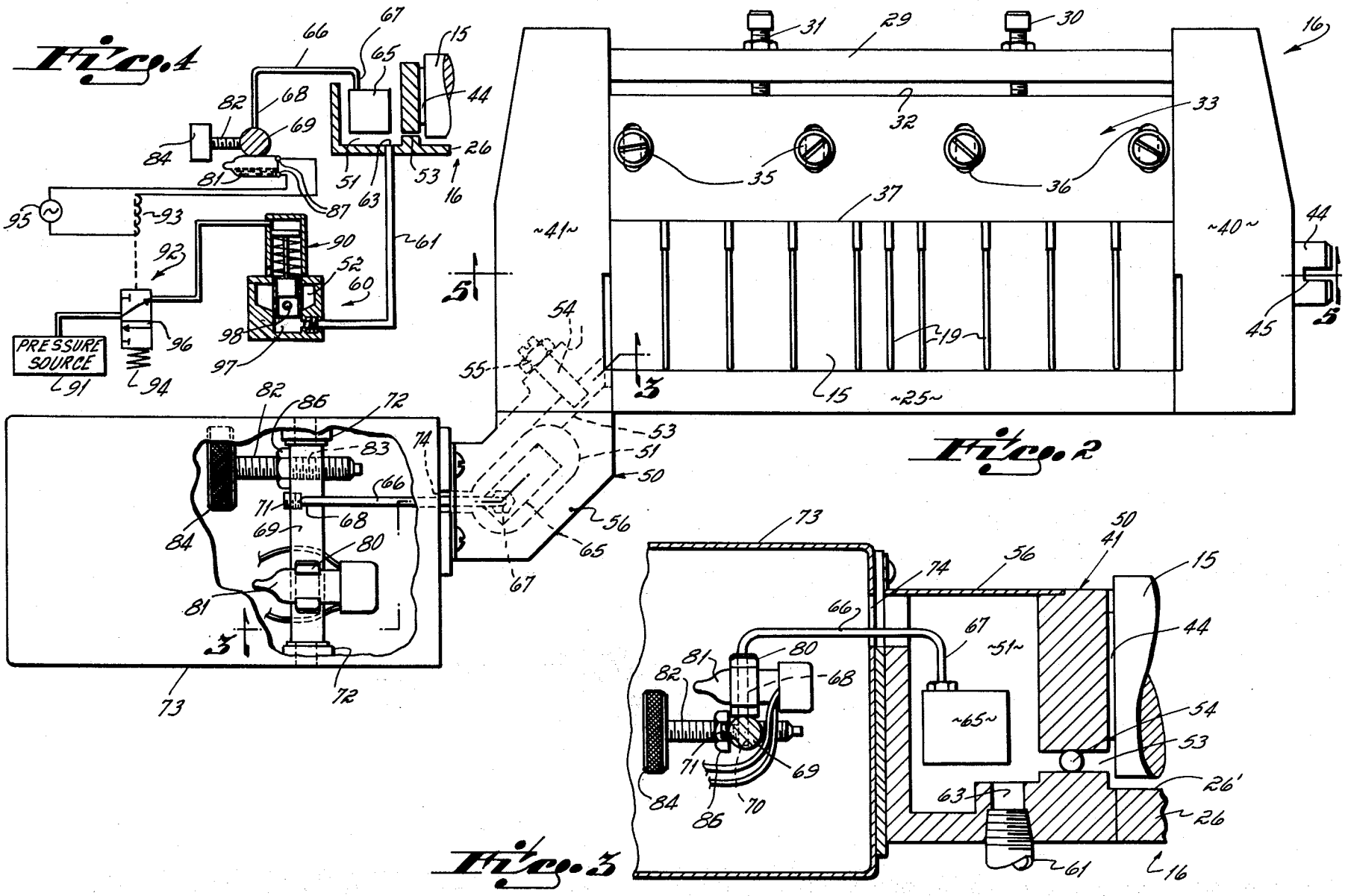
FIG. 2 is a top plan view of the adhesive reservoir section of the machine of FIG. 1.
FIG. 3 is a cross-sectional view taken on line 3—3 of FIG. 2.
FIG. 4 is a partially diagrammatic view of the control system for supplying molten adhesive to the adhesive reservoir of the machine of FIG. 1.

The operation of the reservoir level control may be best understood with reference to FIG. 4. As there illustrated, molten adhesive is supplied from the melt tank 52 via the single acting reciprocating piston pump 60 to the surge tank 51. From the surge tank 51 the molten material flows into the interior of the reservoir 16 via the passage 53.

In one preferred embodiment the pump 60 is a single acting reciprocating piston pump. The term "single acting" refers to a reciprocating piston pump in which the pump is operative during one stroke to pump fluid from the cylinder of the pump and during the opposite stroke to move fluid from the supply reservoir into the pump cylinder. This type of pump is relatively inexpensive and trouble-free and in many instances is preferred for pumping molten adhesive. In the preferred embodiment the pump is actuated by a pneumatic cylinder motor 90, the flow of air pressure to which is controlled from a pressure source 91 via a solenoid operated valve 92. When the solenoid 93 of the valve 92 is energized, the valve is operative to supply air pressure to the top side of the cylinder 90 and to exhaust the bottom side through a vent and when the solenoid 93 is deenergized the valve 92 is operative to connect the top side of the cylinder 90 to exhaust through the valve 92. A spring 94 of the solenoid valve 92 effects displacement of the spool of the valve 92 when the solenoid 93 is deenergized.

In operation, whenever the level of the reservoir 16 falls below a preset level, the displacer 65 moves downwardly in the surge tank 51, thereby causing clockwise rotation of the pivot shaft 69 of the level control. This clockwise rotation of the pivot shaft results in closing of the contacts 87 of the mercury switch 81 attached to the pivot shaft, thereby closing an electrical circuit from a source of electrical energy 95 to the solenoid 93 of the valve 92. Energization of the solenoid 92 results in the spool 96 of the valve 92 being moved upwardly to a position in which air from the source 91 is supplied to the top side of the air cylinder 90, thereby causing the air cylinder and attached piston of the pump to be moved downwardly. In the course of moving downwardly, molten adhesive contained within the chamber 97 of the pump is forced through an outlet one way check valve into the surge tank. The inrush of incoming molten adhesive causes the displacer 65 to move upwardly, thereby rotating the pivot shaft 69 in a counterclockwise direction and opening the circuit to the solenoid 93. Deenergization of the solenoid 93 enables the spring 94 of the valve 92 to move the spool 96 of the valve to a downward position in which the top side of the air cylinder 90 is exhausted through the solenoid valve 92. In this position of the spool 92 a spring of the air cylinder 90 causes the piston of the air cylinder to move upwardly, thereby uncovering inlet ports 98 of the pump and permitting molten adhesive contained in the reservoir 52 to flow into the chamber 97 of the pump preparatory to the next cycle of the level control.

The displacement of the reciprocating piston pump 60 is chosen such that it is operative during each cycle of the pump to fill the surge tank 51 to a level to move the displacer 65 a distance sufficient to close the contacts of the mercury switch. To insure that the molten adhesive does not flow from the surge tank 51 without first moving the displacer 65 a distance sufficient to actuate the switch 81, the rate of flow of molten adhesive from the surge tank 51 is controlled by the adjustable restrictor 54 in the passage 53 between the surge tank and the reservoir. This restrictor limits the rate at which the molten adhesive can flow from the surge tank and insures that the displacement of the pump is sufficient to raise the level of molten adhesive in the surge tank to a level to displace the displacer 65 and actuate the switch 81. To further assist and insure the actuation of the switch 81, the incoming fluid is directed against the bottom side of the displacer. Consequently, the incoming fluid entering the surge tank 51 assists in moving the displacer to a position in which the switch 81 is closed. This positioning of the inlet port has been found to be advantageous in insuring that the condition of the switch 81 is changed during each stroke of the piston pump 60.

The improved reservoir, applicator wheel and stripper fingers of this invention have been found to enable a far greater surge of hot melt adhesive to be utilized in wheel type applicators and applicators that have heretofore been amenable to such applicators. Specifically, this improved applicator system of this invention has been found to be particularly applicable to conversion of "cold" glue labelers to hot melt adhesive labelers with the consequent savings and advantages of hot melt adhesives. Specifically, those advantages have been found to be: quicker bonding of the label to the substrates with resulting elimination of filtering or curling of the labels; adhesion of the labels to materials hereftofore difficult to adhere as for example plastics, waxed papers, metals, etc.; adhesion to wet or soiled surfaces; longer self life of the label; and lower costs for application of labels because of lower adhesive costs and lesser labor requirements for application of the labels.

While we have descibed only a single preferred embodiment of my invention, persons skilled in the art to which it pertains will readily appreciate numerous changes and modifications which may be made without departing from the spirit of our invention. Therefore, we do not intend to be limited except by the scope of the following appended claims.

Having described our invention, we claim:

1. An adhesive applicator device for use in combination with a machine for applying molten adhesive to a substrate comprising an open top reservoir, means for heating said reservoir to maintain adhesive contained therein in a molten state, a wheel mounted for rotation within said reservoir, said wheel having a plurality of annular grooves in the periphery thereof, a doctor blade adjustably mounted upon said reservoir, said doctor blade being operative to control the thickness of a film of adhesive applied by said wheel to a substrate as the substrate is passed over the wheel, a plurality of stripper fingers mounted upon said reservoir and extending over the top of said applicator wheel, each of said stripper fingers having a section thereof located within one of said plurality of annular grooves of said applicator wheel, said sections of said stripper fingers which are located within said grooves of said applicator wheel extending between said doctor blade and said applicator wheel, and a resilient tube surrounding each of said stripper fingers at least at the point at which said stripper fingers extend between said doctor blade and said wheel, said resilient tubes being operative to form a dynamic seal between the doctor blade and the annular grooves of said applicator wheel so as to preclude accumulation of molten adhesive about said stripper fingers at the top of said applicator wheel.

2. The adhesive applicator device of claim 1 in which said resilient tubes are made from "Teflon."

3. The adhesive applicator device of claim 1 in which each of said resilient tubes has an outside diameter slightly larger than the width of said annular grooves in said applicator wheel.

4. The adhesive applicator of claim 3 in which said stripper fingers are circular in cross section and in which said resilient tubes are slightly larger in inside diameter than the outside diameter of said stripper fingers.

5. The adhesive applicator of claim 1 in which one end of each of said stripper fingers is clamped between said doctor blade and said reservoir.

6. The adhesive applicator of claim 5 in which said one end of each of said stripper fingers is surrounded by and encased within said resilient tubing.

7. The adhesive applicator of claim 5 in which each of said stripper fingers is made of spring steel and is preloaded into contact with said periphery of said wheel.

8. The adhesive applicator of claim 1 in which said open top reservoir has a bottom wall, front wall, rear wall and a pair of end walls, said doctor blade being mounted upon said rear wall of said reservoir, and said pair of end walls of said reservoir each having return flow channels on the inside surfaces thereof, said return flow channels being so positioned as to receive molten adhesive from the lateral edges of the underside of said doctor blade and to direct it back to the bottom of said reservoir.

9. The adhesive applicator of claim 8 in which each of said return flow channels of said end walls is generally arcuate in shape and has an upper end located adjacent a lateral edge of said doctor blade, and each of said return flow channels having a lower end located forwardly of said upper end and in a position to empty into the bottom of said reservoir.

10. The adhesive applicator of claim 8 in which said rear wall of said reservoir has a generally arcuate inside surface closely spaced to the peripheral surface of said applicator wheel.

11. The adhesive applicator of claim 10 in which said reservoir has an open bottom section for storage of molten adhesive, said open bottom section of said reservoir being located forwardly of a vertical plane through the axis of said applicator wheel.

12. An adhesive applicator device for use in combination with a machine for applying molten adhesive to a substrate comprising an open top reservoir, and reservoir having a bottom wall, a front wall, a rear wall, and a pair of opposed end walls, means for heating said reservoir to maintain adhesive contained therein in a molten state, an applicator wheel mounted for rotation within said reservoir, a doctor blade adjustably mounted upon said rear wall of said reservoir, said doctor blade having a leading edge located in close proximity to said applicator wheel such that said blade is operative to control the thickness of a film of adhesive applied by said wheel to a substrate as the substrate is passed over the wheel, and means for maintaining a continuous flow of molten adhesive along the underside of said doctor blade when said applicator wheel is rotating within said reservoir and a pool of molten adhesive is present in the bottom of said reservoir, said last named means including return flow channels on the inside surfaces of each of said end walls, said return flow channels being so positioned as to receive molten adhesive from the lateral edges of the underside of said doctor blade and to direct said molten adhesive in the direction of rotation of the applicator wheel back to the bottom of said reservoir.

13. The adhesive applicator of claim 12 in which each of said return flow channels of said end walls is generally arcuate in shape and has an upper end located adjacent a lateral edge of said doctor blade, and each of said return flow channels having a lower end located forwardly of said upper end and in a position to empty into the bottom of said reservoir.

14. The adhesive applicator of claim 12 in which said rear wall of said reservoir has a generally arcuate inside surface closely spaced to the peripheral surface of said applicator wheel.

15. The adhesive applicator of claim 14 in which said reservoir has an open bottom section for storage of molten adhesive, said open bottom section of said reservoir being located forwardly of a vertical plane through the axis of said applicator wheel.

16. An adhesive applicator device for use in combination with a machine for applying adhesive to a substrate comprising an open top reservoir, said reservoir having a bottom wall, a front wall, a rear wall, and a pair of opposed end walls, an applicator wheel mounted from rotation within said reservoir, a doctor blade adjustably mounted upon said rear wall of said reservoir, said doctor blade having a leading edge located in close proximity to said applicator wheel such that said blade is operative to control the thickness of a film of adhesive applied by said wheel to a substrate as the substrate is passed over the wheel, and means for maintaining a continuous flow of adhesive along the underside of said doctor blade when said applicator wheel is rotating within said reservoir and a pool of adhesive is present in the bottom of said reservoir, said last named means including return flow channels on the inside surfaces of each of said end walls, said return flow channels being so positioned as to receive adhesive from the lateral edges of the underside of said doctor blade and to direct said adhesive in the direction of rotation of the applicator wheel back to the bottom of said reservoir.

17. An adhesive applicator device for use in combination with a machine for applying adhesive to a substrate comprising an open top reservoir, a wheel mounted for rotation within said reservoir, said wheel having a plurality of annular grooves in the periphery thereof, a doctor blade adjustably mounted upon said reservoir, said doctor blade being operative to control the thickness of a film of adhesive applied by said wheel to a substrate as the substrate is passed over the wheel, a plurality of stripper fingers mounted upon said reservoir and extending over the top of said applicator wheel, each of said stripper fingers having a section thereof located within one of said plurality of annular grooves of said applicator wheel, said sections of said stripper fingers which are located within said grooves of said applicator wheel extending between said doctor blade and said applicator wheel, and a resilient tube surrounding each of said stripper fingers at least at the point at which said stripper fingers extend between said doctor blade and said wheel, said resilient tubes being operative to form a dynamic seal between the doctor blade and the annular grooves of said applicator wheel so as to preclude accumulation of molten adhesive about said stripper fingers at the top of said applicator wheel.

* * * * *

UNITED STATES PATENT AND TRADEMARK OFFICE

CERTIFICATE OF CORRECTION

PATENT NO. : 3,965,856

DATED : June 29, 1976

INVENTOR(S) : Charles H. Scholl, Alan B. Reighard

It is certified that error appears in the above-identified patent and that said Letters Patent are hereby corrected as shown below:

Col. 2, line 57, delete "then"

Col. 4, line 36 "of" should be -- for --

Col. 8, line 36 "filtering" should be --lifting--

Col. 8, line 40, "self" should be -- shelf --

Col. 9, line 66, "and" should be -- said --

Signed and Sealed this

Sixteenth Day of November 1976

[SEAL]

*Attest:*

RUTH C. MASON
*Attesting Officer*

C. MARSHALL DANN
*Commissioner of Patents and Trademarks*